US005266997A

United States Patent [19]

Nakane et al.

[11] Patent Number: 5,266,997

[45] Date of Patent: Nov. 30, 1993

[54] ELECTROPHOTOGRAPHIC IMAGE FORMING APPARATUS INCLUDING MEANS FOR CORRECTING DENSITY DRIFT

[75] Inventors: Rintaro Nakane, Yokohama; Jiro Egawa, Yokosuka; Shigeru Fujiwara, Yokohama, all of Japan

[73] Assignee: Kabushiki Kaisha Toshiba, Kawasaki, Japan

[21] Appl. No.: 965,785

[22] Filed: Oct. 23, 1992

Related U.S. Application Data

[62] Division of Ser. No. 855,871, Mar. 23, 1992, Pat. No. 5,196,886.

[30] Foreign Application Priority Data

Jun. 26, 1991 [JP] Japan ..... 3-154338

[51] Int. Cl.[5] ..... G03G 21/00

[52] U.S. Cl. ..... 355/208; 355/214; 355/246; 358/300; 358/458

[58] Field of Search ..... 355/203, 204, 208, 214, 355/225, 246; 358/75, 80, 300, 298, 458, 461, 456; 346/160

[56] References Cited

U.S. PATENT DOCUMENTS

| | | | |
|---|---|---|---|
| 4,318,610 | 3/1982 | Grace | 355/246 |
| 4,975,747 | 12/1990 | Higuchi | 355/246 |
| 5,107,302 | 4/1992 | Bisaiji | 355/246 |
| 5,148,289 | 9/1992 | Nishiyama et al. | 358/300 |
| 5,206,686 | 4/1993 | Fukui et al. | 355/208 |
| 5,212,560 | 5/1993 | Hattori et al. | 358/80 X |

*Primary Examiner*—A. T. Grimley
*Assistant Examiner*—William J. Royer
*Attorney, Agent, or Firm*—Foley & Lardner

[57] ABSTRACT

A toner sensor measures the amount of toner attached onto a photosensitive drum upon development by a developing unit. A controller compares the measured toner attaching amount with a predetermined reference value, and executes processing for changing at least one of image forming conditions, for example, the charging amount by a charger, the developing bias voltage of the developing unit, the exposure amount of an optical system, and the toner density of the developing unit, on the basis of the comparison result.

7 Claims, 21 Drawing Sheets

ELECTROPHOTOGRAPHIC IMAGE FORMING APPARATUS INCLUDING MEANS FOR CORRECTING DENSITY DRIFT

This application is a divisional of application Ser. No. 07/855,871, filed Mar. 23, 1992, now U.S. Pat. No. 5,196,886.

BACKGROUND OF THE INVENTION

1. Field of the Invention

The present invention relates to an electrophotographic color image forming apparatus, such as a color laser printer, a color digital copying machine, and the like.

2. Description of the Related Art

For example, many users find that copies obtained by copying the same original using the same copying machine have different densities. In an electrophotograph, an image density drift occurs under the influence of a change or deterioration of image forming conditions due to different environmental factors and an elapse of time. It is important for a multi-level printer or a digital copying machine, as well as an analog copying machine, to suppress and stabilize the image density drift. In particular, in a color image, since the image density drift influences not only density reproducibility but also color reproducibility, a stable image density is an indispensable requirement. Therefore, in a conventional apparatus, a given allowable margin is provided to image forming materials and an image forming process itself, and image stabilization is attained by maintenance within this allowable margin.

However, the allowable margin to be provided to the image forming materials and image forming process itself is limited, and maintenance requires a great deal of labor and cost. Furthermore, the image density drift cycle is shorter than the maintenance cycle, and a stable image density cannot always be obtained entirely by maintenance.

SUMMARY OF THE INVENTION

It is an object of the present invention to provide an image forming apparatus, which can correct an image density drift due to a change in environment or deterioration over time independently of the maintenance and at a shorter cycle than the maintenance cycle, can stabilize a high image density, and can reduce maintenance costs.

An image forming apparatus according to the present invention comprises latent image forming means for forming a latent image on an image carrier on the basis of image data, developing means for developing the latent image formed on the image carrier by the latent image forming means with a developing agent, developing agent attaching amount measuring means for measuring an attaching amount of the developing agent attached on the image carrier upon development by the developing means, comparing means for comparing a measurement value from the developing agent attaching amount measuring means with a predetermined reference value, and image forming condition changing means for changing an image forming condition in the latent image forming means or the developing means according to a comparison result from the comparing means.

The amount of the developing agent attached to the image carrier upon development is measured. The measured attaching amount of the developing agent is compared with a predetermined reference value. At least one of the charging amount for the image carrier, the developing bias voltage, the exposure amount, the density of the developing agent, and the like is changed on the basis of the comparison result. Thus, an image density drift due to a change in environment or a deterioration over time can be corrected independently of maintenance, and with a shorter cycle than the maintenance cycle. As a result, a high image density can be stabilized, and cost (labor cost, equipment, and the like) required for the maintenance can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will be described hereinafter with reference to the accompanying drawings.

Figure 1:
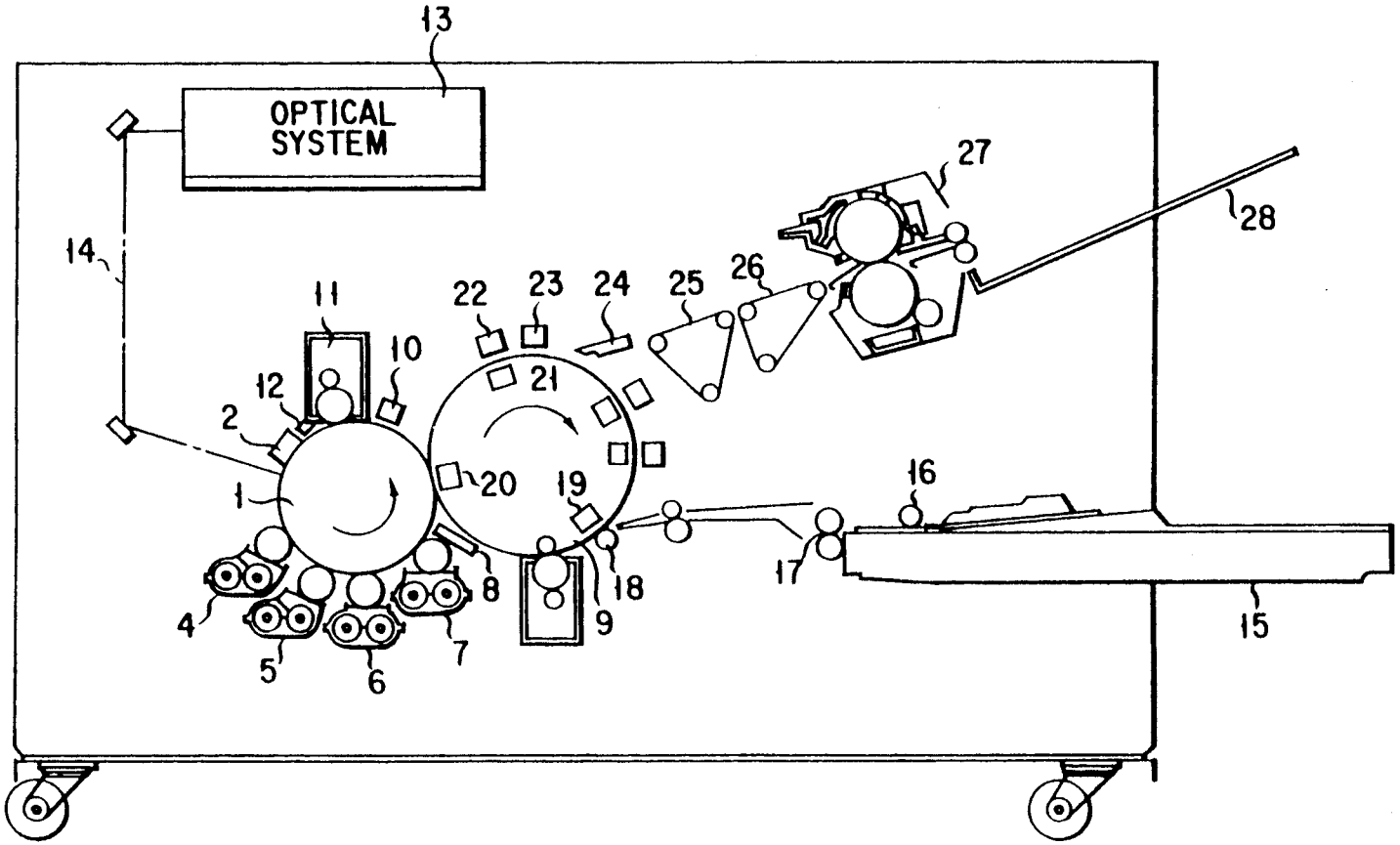
FIG. 1 is a schematic sectional view of a color laser printer.

FIG. 1 shows an arrangement of a color laser printer as an embodiment of an image forming apparatus according to the present invention. In FIG. 1, reference numeral 1 denotes a photosensitive drum as an image carrier, which is rotated counterclockwise with respect to the drawing surface. Charger 2 as a charging means, first, second, third, and fourth developing units 4, 5, 6, and 7 as developing means, toner sensor 8, transfer drum 9 as a transfer medium support member, precleaning discharger 10, cleaner 11, and discharging lamp 12 are sequentially arranged around photosensitive drum 1.

Photosensitive drum 1 is rotated in a direction of the arrow in FIG. 1, and its surface is uniformly charged by charger 2. The surface of photosensitive drum 1 is exposed by laser beam 14 emerging from optical system 13 as an exposure means through a portion between charger 2 and first developing unit 4, thereby forming an electrostatic latent image according to image data.

First to fourth developing units 4 to 7 visualize electrostatic latent images corresponding to respective colors on photosensitive drum 1 to color toner images, using prescribed developing materials. For example, first developing unit 4 performs magenta development, second developing unit 5 performs cyan development, third developing unit 6 performs yellow development, and fourth developing unit 7 performs black development.

Meanwhile, a transfer sheet as a transfer medium is fed from paper feed cassette 15 by paper feed roller 16, and is temporarily registered by registration rollers 17. The sheet is then fed by registration rollers 17, so that it is attracted at a predetermined position of transfer drum 9. The sheet is electrostatically attached on transfer drum 9 by attraction roller 18 and attraction charger 19. The transfer sheet is conveyed upon clockwise rotation of transfer drum 9 while being attracted onto transfer drum 9.

The developed toner image on photosensitive drum 1 is transferred onto the transfer sheet by transfer charger 20 at a position where photosensitive drum 1 opposes transfer drum 9. In a multi-color printing operation, a process that defines one cycle by one revolution of transfer drum 9 is performed while switching the developing unit. As a result, a plurality of color toner images are multiple-transferred onto the transfer sheet.

The transfer sheet on which the toner images are transferred is further conveyed upon rotation of transfer drum 9, and is discharged by pre-peeling inner discharger 21, pre-peeling outer discharger 22, and peeling discharger 23. Thereafter, the sheet is peeled from transfer drum 9 by peeling pawl 24, and is then conveyed to fixing unit 27 by conveyor belts 25 and 26. Toners on the transfer sheet, which are heated by fixing unit 27, are melted to be fixed on the transfer sheet immediately after the sheet is delivered from fixing unit 27. The transfer sheet after the fixing operation is delivered onto tray 28.

Figure 2:
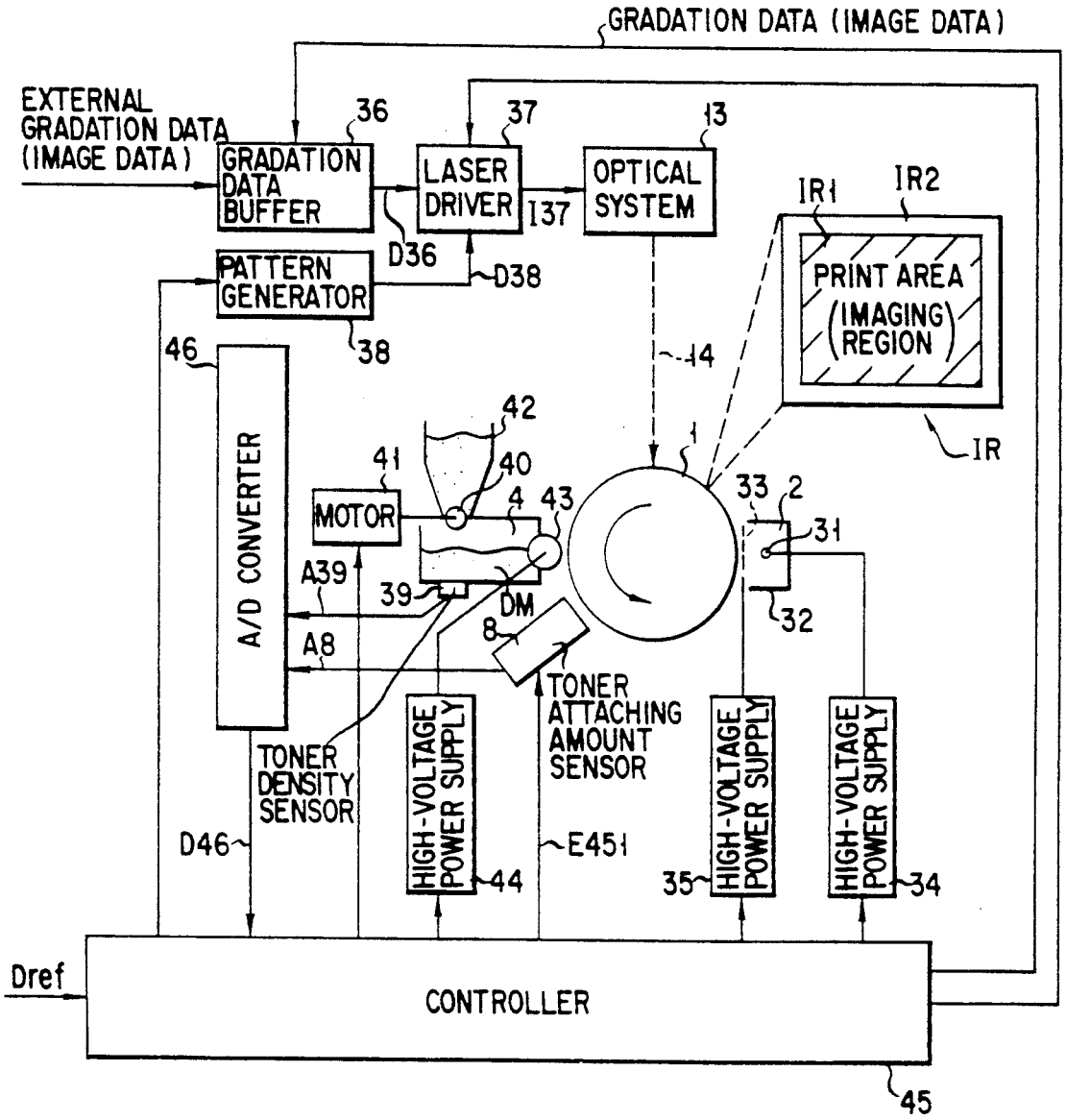
FIG. 2 is a block diagram showing charging, exposure, and developing means of a color laser printer according to an embodiment of the present invention, and their control means.

FIG. 2 is a block diagram showing charging, exposure, and developing means for a color laser printer according to an embodiment of the present invention, and its control means. In FIG. 2, photosensitive drum 1 is rotated counterclockwise (in a direction of an arrow in FIG. 2) with respect to the drawing surface. Charger 2 mainly comprises charging wire 31, conductive case 32, and grid electrode 33. Charging wire 31 is connected to corona high-voltage power supply 34, and performs corona discharging to charge the surface of photosensitive drum 1. Grid electrode 33 is connected to grid bias high-voltage power supply 35, and controls the charging amount on the surface of photosensitive drum 1 according to a grid bias voltage.

The surface, uniformly charged by charger 2, of photosensitive drum 1 is exposed by modulated laser beam 14 from optical system 13, thereby forming an electrostatic latent image thereon. Gradation data buffer 36 stores gradation data (image data) from an external apparatus (not shown) or controller 45, corrects printer gradation characteristics of the stored data, and converts it into laser exposure time (pulse width) data.

Laser driver 37 modulates a laser drive current (light emission time) according to laser exposure time data D36 from gradation data buffer 36 in synchronism with a scan position of laser beam 14. The modulated laser drive current drives a semiconductor laser oscillator (not shown) in optical system 13. Thus, the semiconductor laser oscillator performs a light-emission operation according to the exposure time data.

Furthermore, laser driver 37 compares an output from a monitor light-receiving element (not shown) in optical system 13 with a set value so as to make control for maintaining the output light amount of the semiconductor laser oscillator to be the set value using drive current I37. (This control is performed by APC circuit 3704 in FIG. 2A.)

On the other hand, pattern generator 38 generates gradation data D38 for a test pattern of the printer, and for a pattern used in toner attaching amount measurement, and sends it to laser driver 37.

Figure 2A:
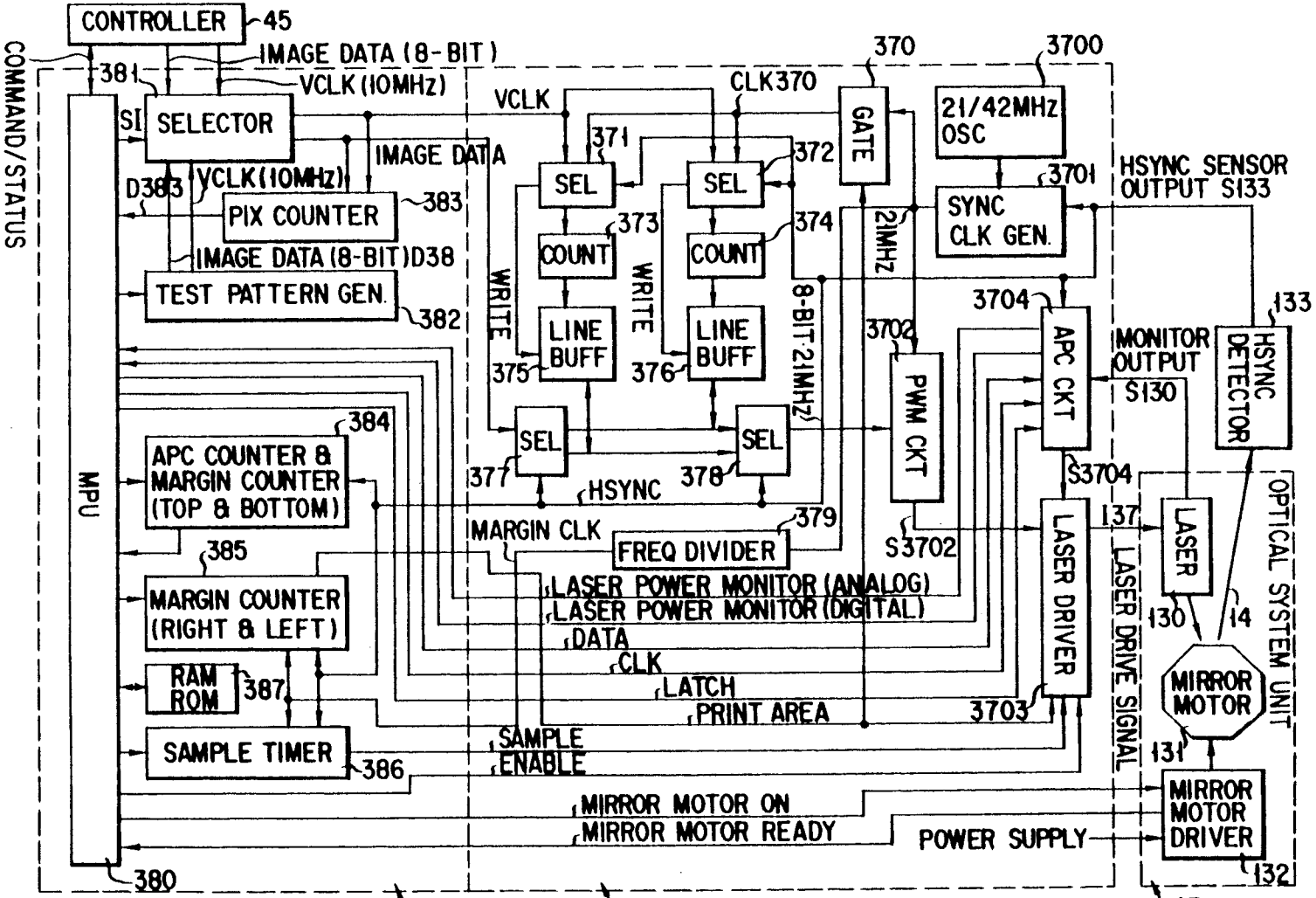
FIG. 2A is a block diagram showing the internal configuration of the laser driver and the pattern generator shown in FIG. 2.

FIG. 2A is a bock diagram exemplifying the internal configuration of laser driver 37 and pattern generator 38.

Controller 45 exchanges command/status between microprocessor (MPU) 380 in pattern generator 38, and supplies selector 381 with, for example, image data of 8-bit/pixel and 10 MHz video clock VCLK in response to the contents of the command/status.

Also supplied to selector 381 are 8-bit/pixel image data (256-color or 256-gray scale) for producing a predetermined test pattern and 10 MHz video clock VCLK, obtained from test pattern generator 382.

When a normal printing is performed, selector 381 selects the image data and video clock from controller 45 in response to selection instruction S1 from MPU 380. When toner attaching amount Q is to be detected, selector 381 selects the image data (D38) and video clock from test pattern generator 382.

The content of the test pattern generated by test pattern generator 382 can be optionally changed to other desired patterns in accordance with a prescribed software executed by MPU 380 using memory 387.

The image data and video clock VCLK selected by selector 381 are input to pixel counter 383. Counter 383 counts clock VCLK during a period in which the image data exceeds a predetermined level. Count data D383 corresponding to this period is fed back to MPU 38 from counter 383. In response to fed-back count data D383, MPU 380 checks the contents of the image data output from selector 381.

A 10 MHz video clock VCLK selected by selector 381 is input to selectors 371 and 372 in laser driver 37. The image data selected by selector 381 is input to selector 377 in laser driver 37.

Each of selectors 371 and 372 selects either the 10 MHz video clock VCLK on the 21 MHz sync clock CLK370 sent from gate 370, in response to the signal level of HSYNC output S133 from horizontal sync (HSYNC) detector 133.

Sync clock CLK370 is obtained by gating the 21 MHz output of sync clock generator 3701 with a signal indicating a prescribed print area. The 21 MHz output of generator 3701 in produced from 21 MHz/42 MHz primary crystal oscillator 3700 in synchronization with HSYNC output S133.

One of clocks VCLK and CLK370 selected by selector 371 or 372 is counted by counter 373 or 374 during a high (or low) level period of HSYNC output S133.

The count result of counter 373 or 374 is written into line buffer 375 or 376 when selector 371 or 372 changes its selection state. The data written in buffer 375 is sent to one output circuit of selector 377, and the data written in buffer 376 is sent to the other output circuit of selector 377.

The two outputs of selector 377 are input to selector 378. Selector 377 sends the image data from selector 381 to one of its two output circuits, in response to the signal level of HSYNC output S133 from HSYNC detector 133.

In response to the signal level of HSYNC output S133, selector 378 selects one of the two outputs of selector 377, on which the outputs of buffers 375 and 376 are imposed. The selected test pattern data of, for example 8-bit/21 MHz, is input to pulse width modulation (PWM) circuit 3702.

In response to HSYNC output S133 from HSYNC detector 133, PWM circuit 3702 supplies laser driver 3703 with PWM signal S3702 corresponding to input test pattern data (image data).

In response to PWM signal S3702, laser driver 3703 controls drive current 137 for laser diode 130 on the basis of control output S3704 from automatic power control (APC) circuit 3704 Monitor output S130 indicating the driving state of laser diode 130 is fed back to control circuit 3704.

The laser beam emitted from laser diode 130 is reflected by a rotating mirror driven by mirror motor 131, so that the reflected beam scans over photosensitive drum 1 shown in FIG. 2. The reflection beam of the scanning beam is detected by HSYNC detector 133, and detector 133 generates HSYNC output S133 in synchronization with the scanning (horizontal scanning).

Mirror motor 131 is driven by mirror motor driver 132. A mirror motor on instruction and mirror motor ready instruction are exchanged between MPU 380 and driver 132 in order to control mirror motor 131.

HSYNC output S133 is input to APC counter 384 controlled by MPU 380. Counter S133 also serves as a top/bottom margin counter of a print area (or imaging region IR1). HSYNC output S133 is also input to right-/left margin counter 385 for the print area and to sample timer 386 for controlling the sampling of PWM signal S3702.

Further input to counter 385 and timer 386 is a margin clock which is obtained by frequency-dividing the 21 MHz output from sync clock generator 3701, by frequency divider 379.

MPU 380 controls the operations of APC circuit 3704 and laser driver 3703, while performing signal exchanges with counters 384 and 385 and timer 386. These controls further includes laser power monitors (analog/digital), data exchanges, a clock supply, data latching, a print area designation, a sample designation, and a laser drive enable.

Photosensitive drum 1 on which an electrostatic latent image is formed is developed by developing unit 4. Developing unit 4 employs, e.g., a two-component developing system, and stores developing agent DM consisting of a toner and a carrier. The weight ratio (T/D) of the toner to the developing agent (to be referred to as a toner density hereinafter) is measured by toner density sensor 39. Toner replenishment motor 41, for driving toner replenishment roller 40, is controlled according to output A39 from toner density sensor 39, so that the toner in toner hopper 42 is replenished into developing unit 4.

Developing roller 43 of developing unit 4 is formed of a conductive member, and is connected to developing bias high-voltage power supply 44. Roller 43 is rotated while being applied with a developing bias voltage, and causes toner to be attached to an image according to the electrostatic latent image on photosensitive drum 1. A toner image developed in this manner in imaging region IR is transferred onto a transfer sheet, which is supported and conveyed by transfer drum 9. Region IR is formed of actual imaging region IR1 and non-imaging region IR2.

Controller 45, comprising a microcomputer, switches, data to be input to laser driver 37 from laser exposure time data D36 from gradation data buffer 36 to gradation data D38 from pattern generator 38 in synchronism with a timing at which the exposure position on photosensitive drum 1 reaches the position of non-imaging region IR2, thereby exposing a gradation pattern (e.g., a gray scale) for measuring a toner attaching amount on non-image region IR2 on photosensitive drum 1.

The above-mentioned synchronizing switch operation by controller 45 can be achieved as follows.

Figure 18:
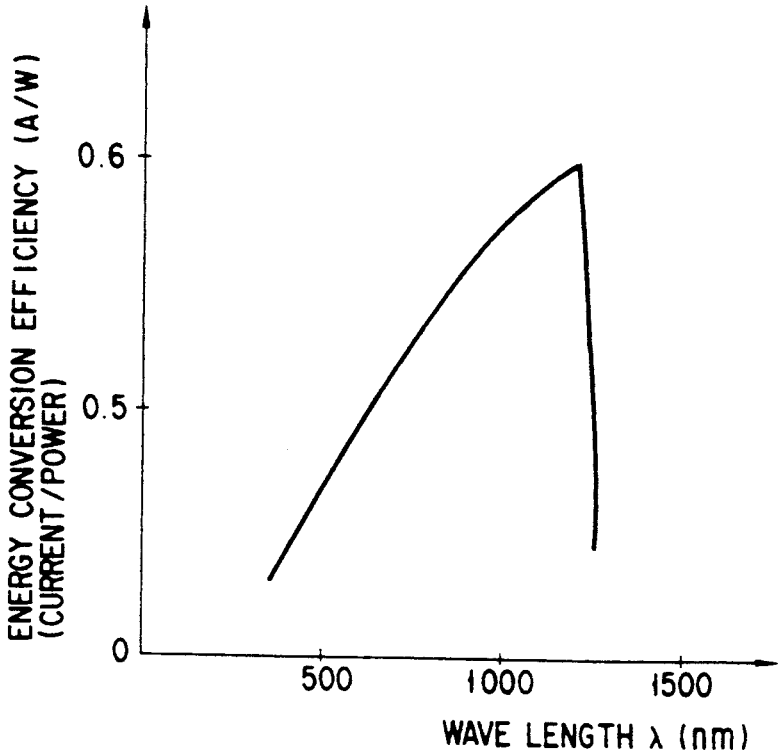
FIG. 18 is a graph showing the photosensitivity characteristics of a photoelectric conversion unit.

A sensor (not shown) for sensing the leading edge position of a print paper is located at the cassette 15 side near roller 18 shown in FIG. 18. This sensor may be formed of a photo-interrupter comprising a pair of an LED and the photo diode. The optical path between the LED and a photo diode is interrupted by the leading edge of the paper.

When the sensor senses the leading edge of the paper fed from the cassette 15 side, a timer (not shown) starts. According to the time passage measured by this timer, controller 45 is informed of the timing that the non-image area on a predetermined position of the paper being fed with a constant speed reaches the exposure position of drum 1.

Toner sensor 8 measures toner attaching amount Q in synchronism with a timing at which the position on photosensitive drum 1, where the gradation pattern is exposed, is developed, and reaches the position of toner sensor 8. Output A8 from toner sensor 8, and output A39 from toner density sensor 39 are digitized by A/D converter 46, and digital output D46 is input to controller 45.

Controller 45 compares data corresponding to output (measurement value) A8 from toner sensor 8 with a predetermined reference value, and executes processing for changing at least one of the grid bias voltage (VG) of charger 2, the developing bias voltage (VD) of developing unit 4, the exposure amount (P) of optical system 13, the toner density (T/D) of the developing agent, the light-emission time (P/D) of area gradation, and the like as image forming conditions according to the comparison result.

The control of voltage VG is effected on power supply 35; voltage VD, on power supply 44; exposure amount P and light-emission time PD, on optical system 13; and toner density T/D, on motor 41.

Controller 45 performs switching control between gradation data from an external apparatus or controller (neither are shown), and gradation data for a test pattern of the printer, and a pattern used in toner attaching amount measurement, fetching control of outputs from sensors 8 and 39, output-amount control of high-voltage power supplies 34, 35, and 44, setting control of a target value of the laser drive current, setting control of a target value of the toner density, toner replenishment control, correction processing of printer gradation characteristics of gradation data, and the like.

Figure 3:
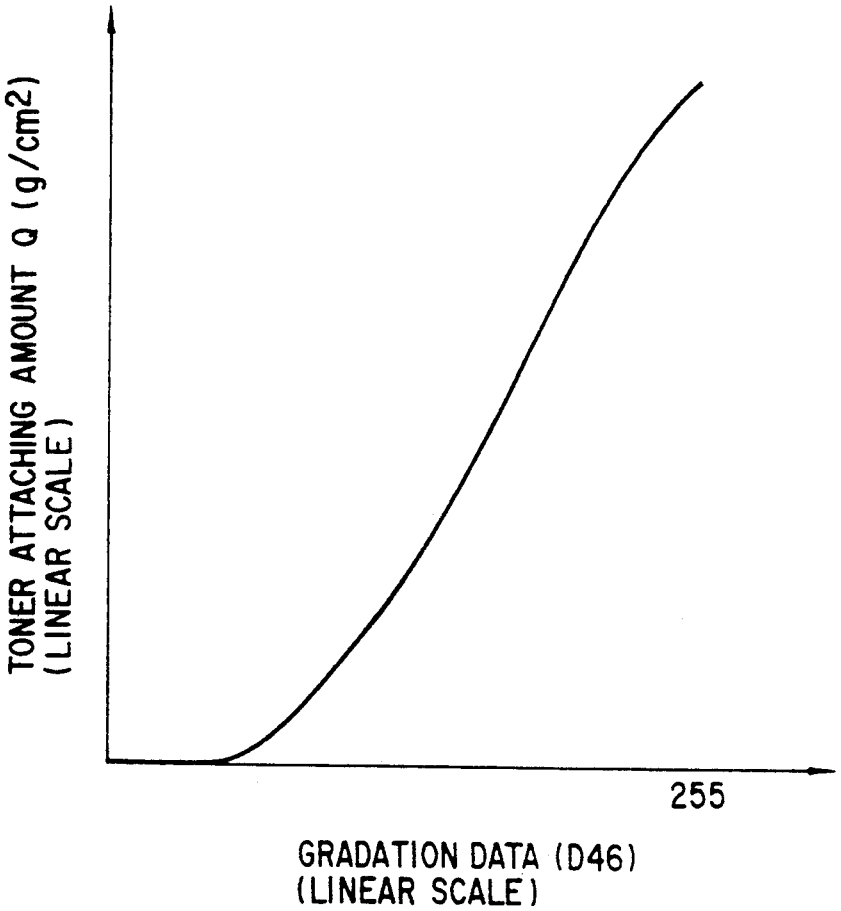
FIG. 3 is a graph showing the toner attaching amount as a function of gradation data.

FIG. 3 shows toner attaching amount Q as a function of gradation data (D46). A curve representing the toner attaching amount as a function of gradation data can be obtained by an actual measurement. This curve is affected by a deviation caused by variations in image forming conditions due to a deterioration over time and a change in environment. Therefore, a small variation of the curve representing the toner attaching amount as a function of gradation data due to a deterioration over time and a change in environment is a necessary condition for stabilizing the image density.

Figure 4:
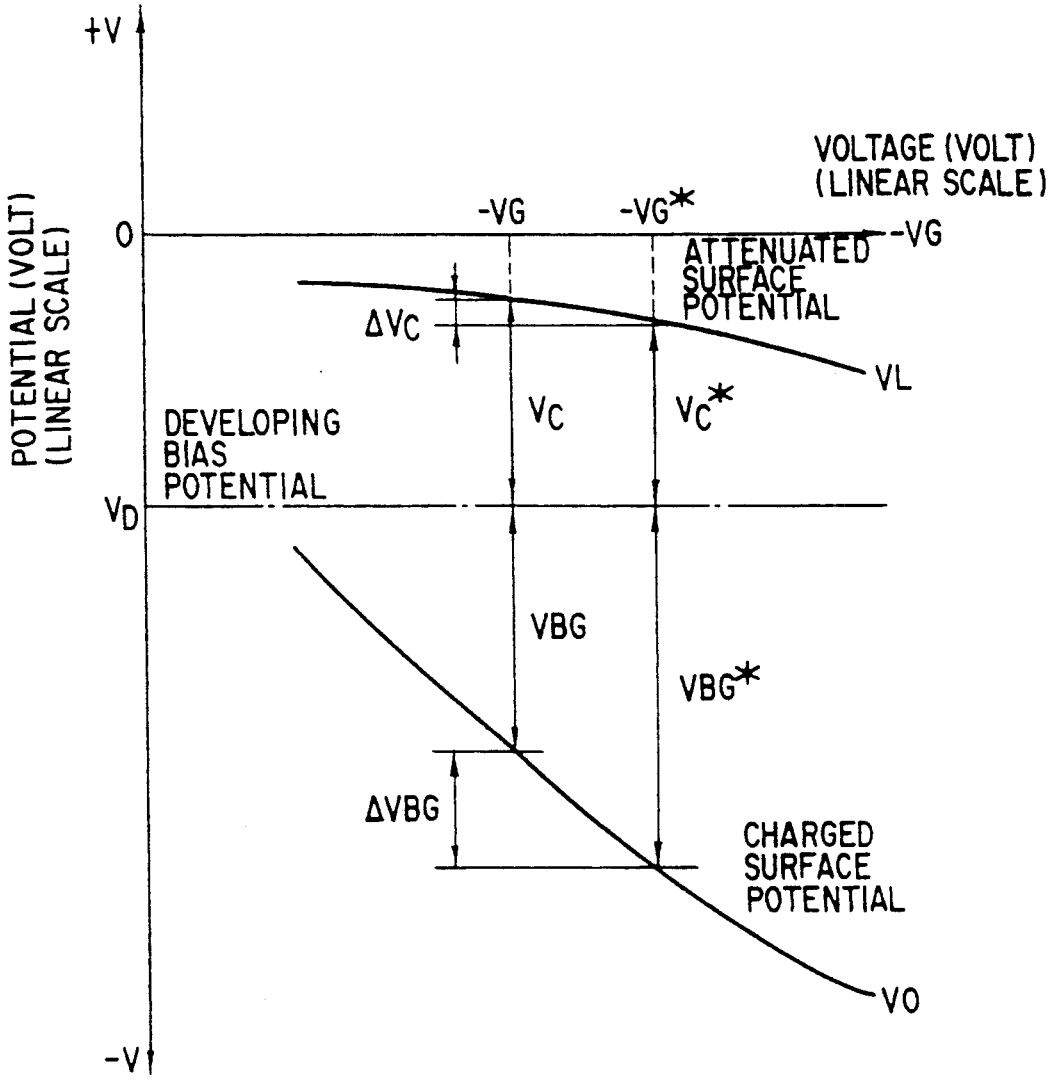
FIG. 4 is a graph showing the potentials of nonexposed and exposed portions of a photosensitive drum, and the developing bias voltage as a function of the grid bias voltage of a charger.

FIG. 4 shows surface potential (to be referred to hereinafter as non-exposed portion potential) V0 of photosensitive drum 1 uniformly charged by charger 2, attenuated surface potential (to be referred to hereinafter as exposed portion potential) VL of photosensitive drum 1, after the entire surface of drum 1 is exposed by a constant light amount by optical system 13, and developing bias voltage VD (an alternate long and short dashed line) with respect to absolute value VG of a bias voltage (to be simply referred to hereinafter as a grid bias voltage) for grid electrode 33 of charger 2.

Since reversal development is performed in this embodiment, a potential or voltage has negative polarity. When grid bias voltage VG is increased, nonexposed portion potential V0 and exposed portion potential VL are respectively decreased. Non-exposed portion potential VO and exposed portion potential VL for grid bias voltage VG can be linearly approximated as follows:

$$V0(VG)=K1\cdot VG+K2 \quad (1)$$

$$VL(VG)=K3\cdot VG+K4 \quad (2)$$

where K1 to K4 are constants.

The developing density changes according to the relationship among developing bias voltage VD, exposed portion potential VL, and non-exposed portion potential V0. Assume that contrast potential VC and background potential VBG are defined as follows:

$$VC=VD(VG)-VL(VG) \quad (3)$$

$$VBG=V0(VG)-VD(VG) \quad (4)$$

Figure 5:
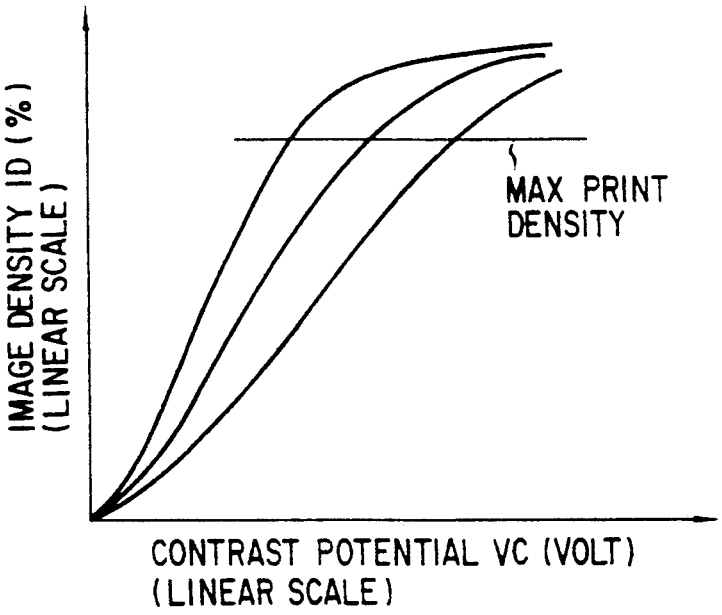
FIG. 5 is a graph showing the image density of a painted portion as a function of the contrast potential.
Figure 6:
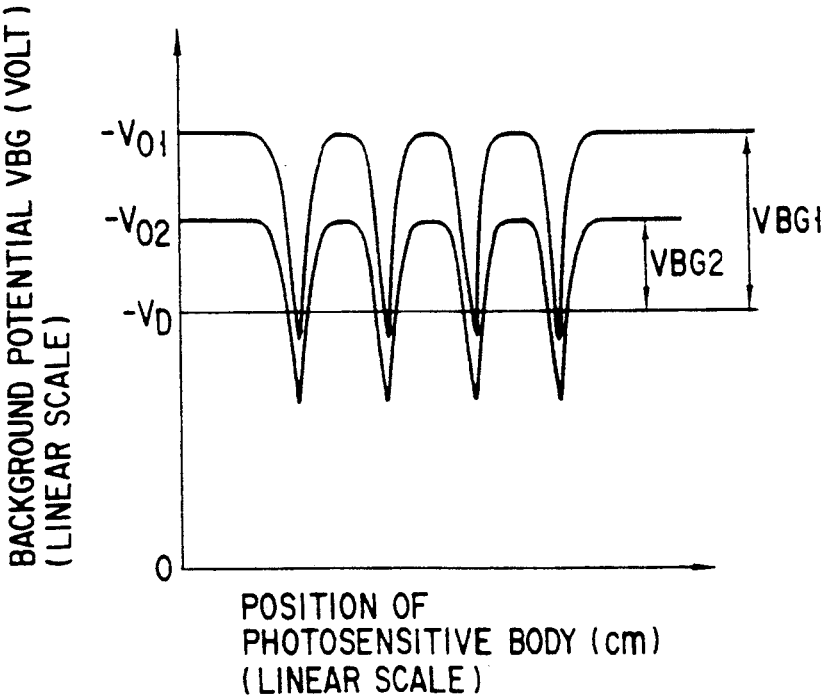
FIG. 6 is a graph showing the relationship among the potential of a non-exposed portion of the photosensitive drum, the potential by a low-density pattern, and the developing bias voltage.

Contrast potential VC depends on the density (especially the maximum density) of a painted portion (see FIG. 5). Background potential VBG is mainly associated with the density of a low-density portion in a multilevel system using pulse width modulation (see FIG. 6).

Figure 7:
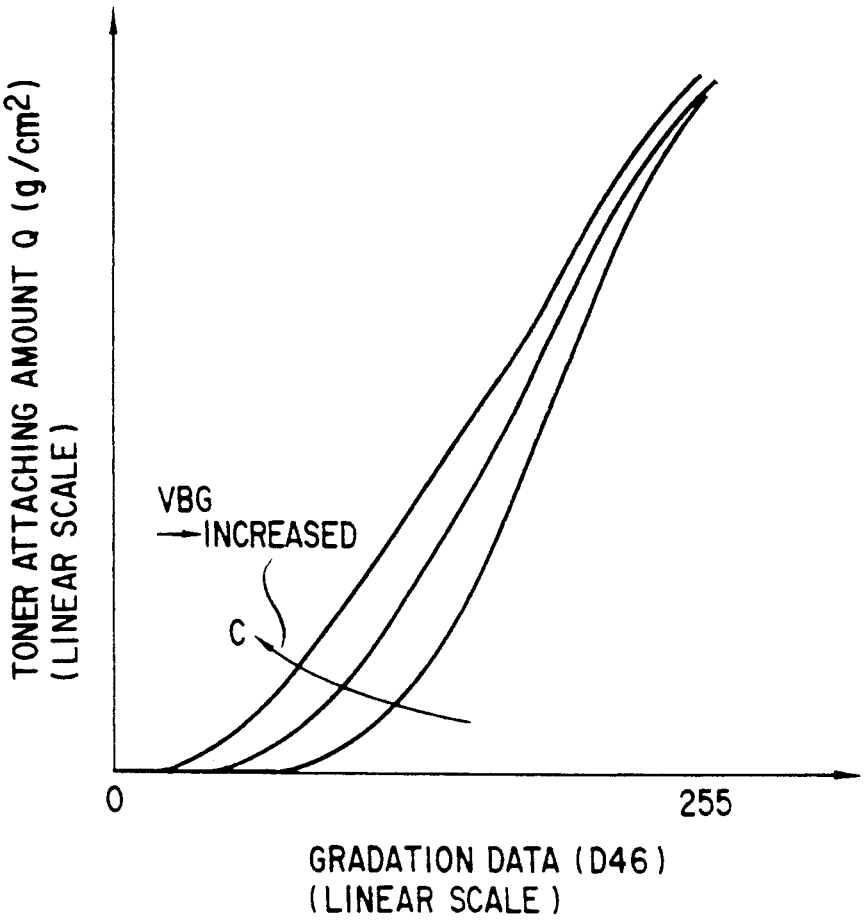
FIG. 7 is a graph showing the toner attaching amount as a function of gradation data obtained when the background potential is changed.

FIG. 7 shows toner attaching amount Q as a function of gradation data when background potential VB is increased. A low-density region is shifted in a direction of an arrow C in FIG. 7. Therefore, the developing density can be changed by contrast potential VC and background potential VBG.

The following equations are obtained from equations (1) to (4):

$$VG(VC, VBG)=(VC+VBG-K2-K4)/(K1+K3) \quad (5)$$

$$VD(VBG, VG)=(K1\cdot VG+K2-VBG) \quad (6)$$

From equations (5) and (6), when the relationship (K1, K2) of exposed portion potential VL and non-exposed portion potential V0 with respect to grid bias voltage VG is known, grid bias voltage VG and developing bias voltage VD can be uniquely determined by determining contrast potential VC and background potential VBG.

The surface potential of photosensitive drum 1 is measured in advance to obtain the relationship (K1, K2) of exposed portion potential VL and non-exposed portion potential V0 with respect to grid bias voltage VG. Thereafter, contrast potential VC and background potential VBG are set. From equations (5) and (6), grid bias voltage VG and developing bias voltage VD are uniquely determined. Under this condition, a plurality of density patterns are formed, and toner attaching amounts Q of these patterns after development are measured. The measured amounts are then compared with a predetermined reference value. Based on deviations ΔQ between the measured amounts and the reference value, correction values ΔVC and ΔVBG of contrast potential VC and background potential VBG for a proper developing density are estimated. Grid bias voltage VG and developing bias voltage VD are set again according to the estimation results, and the toner attaching amounts of the density patterns are measured. These operations are repeated until these voltages fall within an allowable range.

The following parameters are defined:

QH: measured value of toner attaching amount for high density portion of test pattern QL: measured value of toner attaching amount for low density portion of test pattern QHT: reference value toner attaching amount for high density portion of test pattern QLT: reference value of toner attaching amount for low density portion of test pattern ΔQHP: specific control value of toner attaching amount for high density portion of test pattern ΔQLP: specific control value of toner attaching amount for low density portion of test pattern ΔVC: contrast potential change value (correction value)

ΔVBG: background potential change value (correction value)

VG: grid bias potential after changed

VD: developing bias potential after changed

Figure 22:
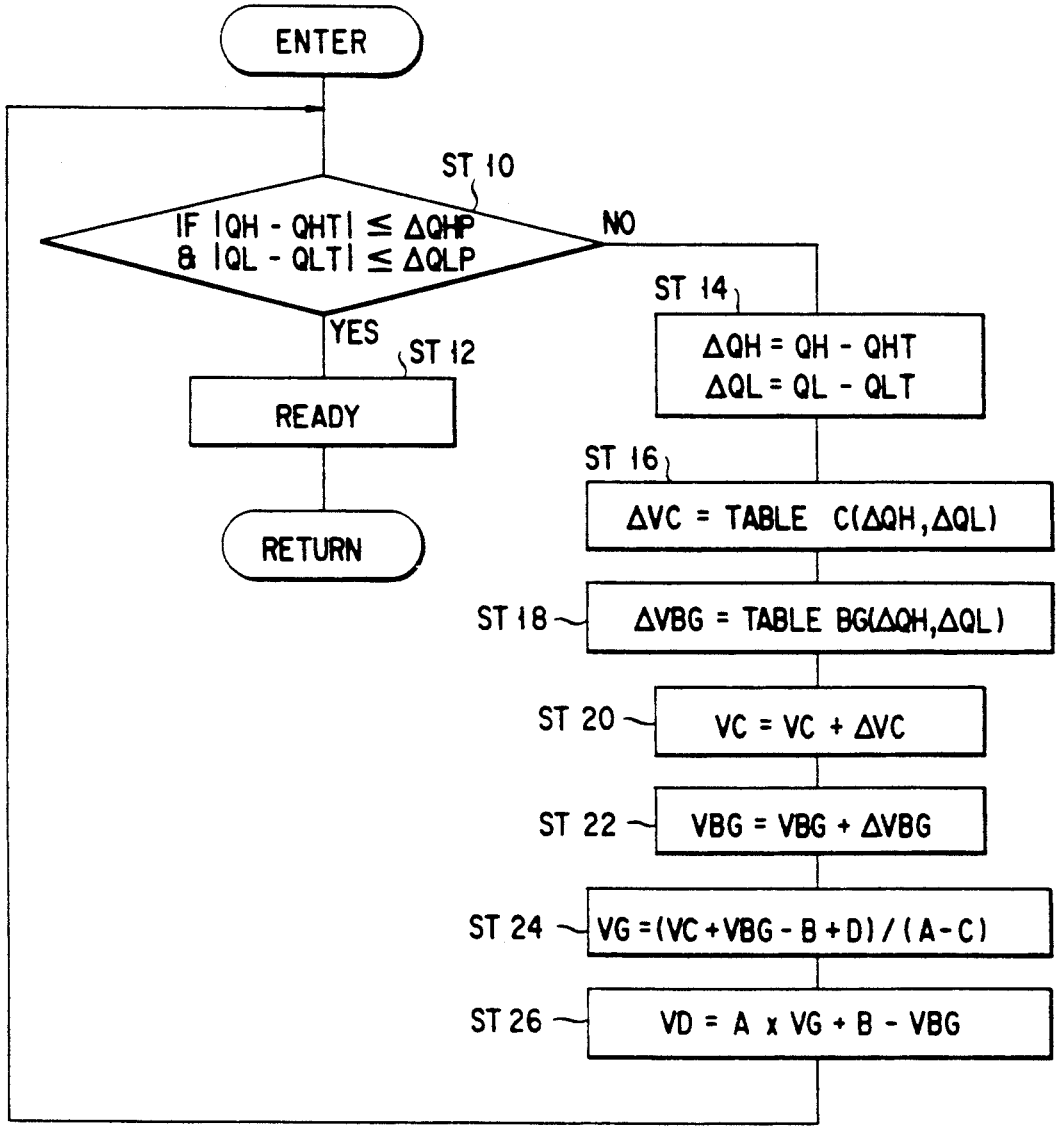
FIG. 22 is a flow chart explaining the algorithm for obtaining image forming conditions.

The estimated correction values (ΔVC and ΔVBG) as well as new image forming conditions (VG and VD) can be obtained according to the following algorithm using the above parameters, as shown by the flow chart of FIG. 22.

if $|QH - QHT| \leqq \Delta QHP$ and $|QL - QLT| \leqq \Delta QLP$ (ST10), then ready (ST12)

else $$\left.\begin{aligned}\Delta QH &= QH - QHT\\ \Delta QL &= QLT\end{aligned}\right\}(ST14)$$

$$\Delta VC = \text{TABLE } C(\Delta QH, \Delta QL) \quad (ST16)$$

$$\Delta VBG = \text{TABLE } BG(\Delta QH, \Delta QL) \quad (ST18)$$

$$VC = VC + \Delta VC \quad (ST20)$$

$$VBG = VBG + \Delta VBG \quad (ST22)$$

$$VG = (VC + VBG - B + D)/(A - C) \quad (ST24)$$

$$VD = A \cdot VG + B - VBG \quad (ST26)$$

Using the values of VG and VBG obtained according to the above algorithm, the toner attaching amount measurement sequence can be executed by controller 45.

Incidentally, as shown in FIG. 4, ΔVC and ΔVBG can be obtained by measuring potential differences VC, VC*, VBG, and VBG* of surface potentials VL and VO with respect to developing bias potential VD, respectively, at two grid biases −VG and −VG*.

Figure 9:
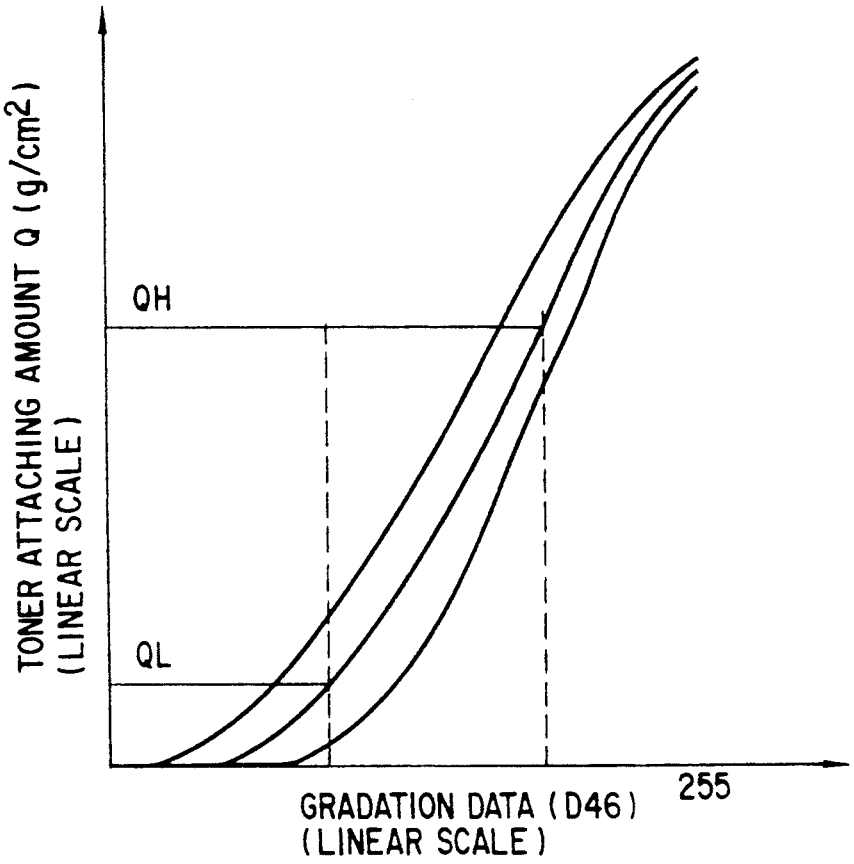
FIG. 9 is a graph showing the toner attaching amount as a function of gradation data obtained when the exposure amount is changed.

The values of QH and QL for calculating ΔQH and ΔQL can be measured according to the relation shown in FIG. 9 or 11 which will be mentioned later. Based on ΔVC, ΔVBG, ΔQH, and ΔQL thus obtained, the contents of TABLE C and TABLE BG can be determined by actual measurement. These tables may be stored in memory 387, shown in FIG. 2A.

Figure 8:
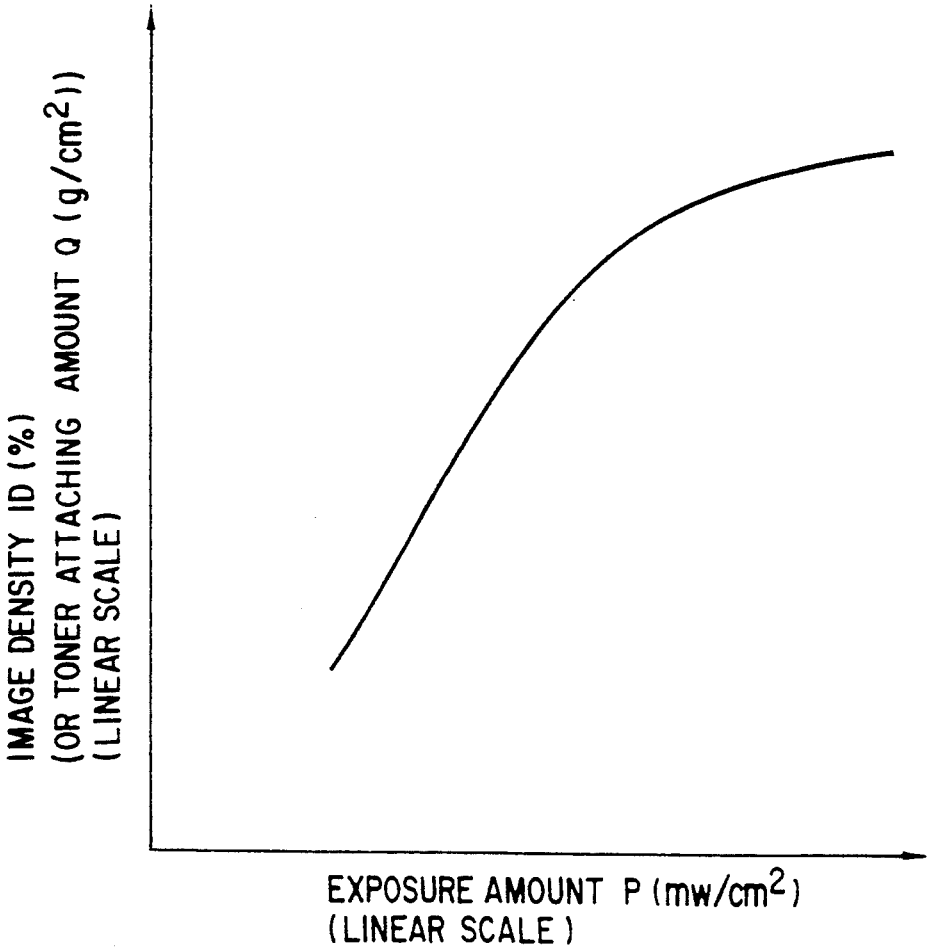
FIG. 8 is a graph showing the image density of a painted portion as a function of the exposure amount.

FIG. 8 shows image density ID of a painted portion, or toner attaching amount Q, as a function of exposure amount P of a laser beam. This embodiment uses a region where image density ID begins to be saturated with respect to exposure amount P. When the light amount is changed, a low-density portion is mainly changed (see FIG. 9). Therefore, correction can be performed by changing the exposure amount with reference to a variation of the low-density portion.

Figure 10:
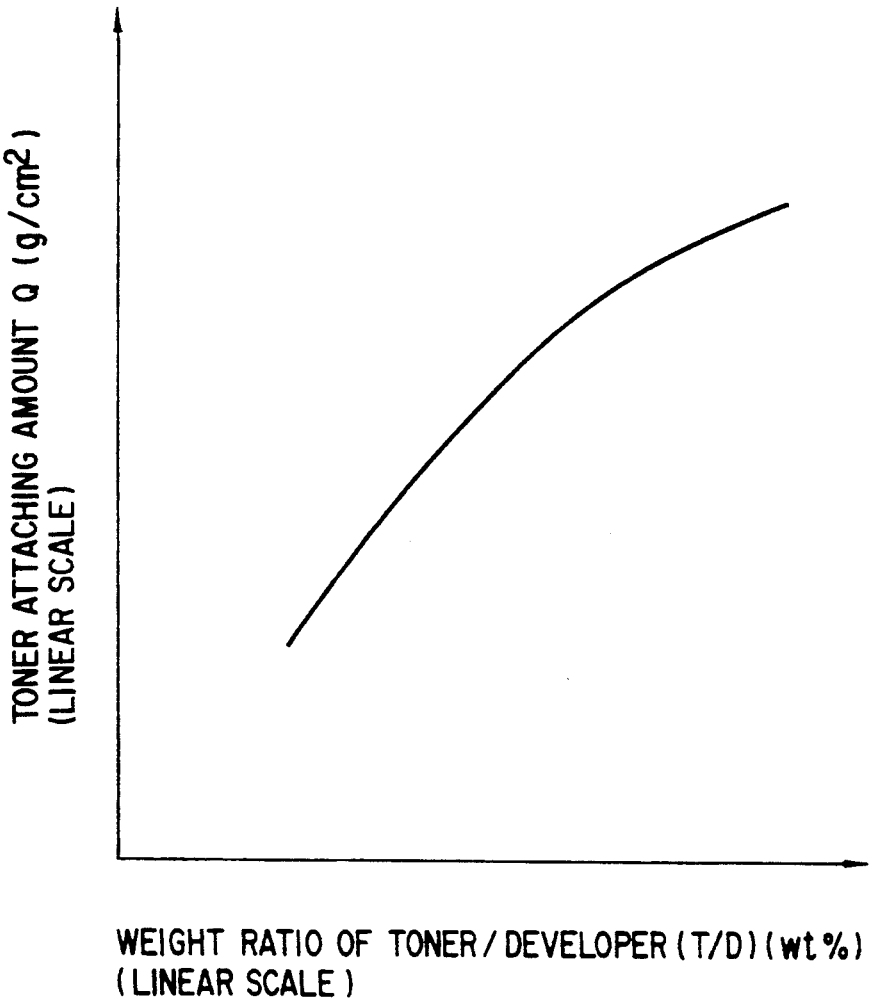
FIG. 10 is a graph showing the relationship between the toner density and the toner attaching amount.

FIG. 10 shows the relationship between toner density T/D and toner attaching amount Q. Toner attaching amount Q mountainously increases as a function of toner density T/D. A toner density lower limit value is determined by experiences based on attachment of the carrier onto photosensitive drum 1, and another toner density upper limit value is determined by experiences based on problems such as an increase in non-charged toner. The toner density is changed within a range defined between these values.

Figure 11:
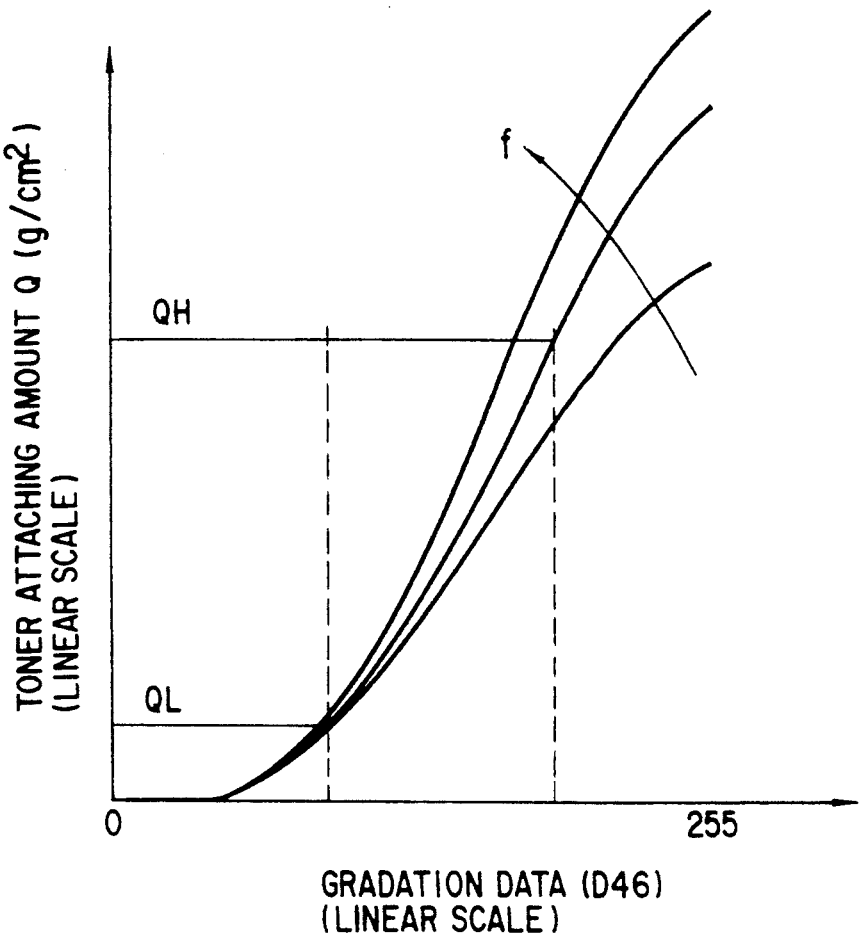
FIG. 11 is a graph showing a change in toner attaching amount as a function of gradation data when the toner density is increased.

FIG. 11 shows a change in toner attaching amount Q as a function of gradation data when the toner density is increased.

Figure 12:
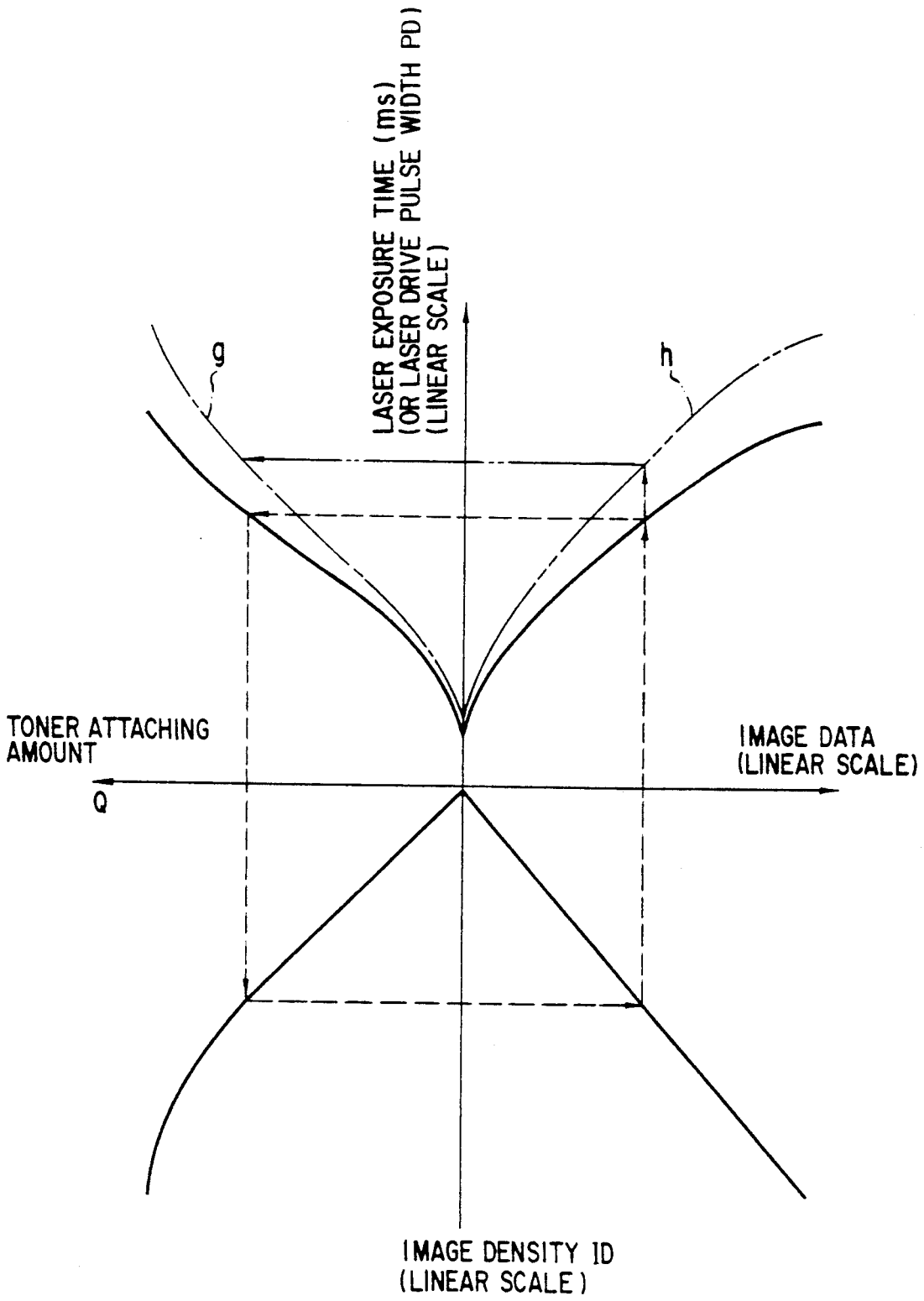
FIG. 12 is a graph showing the relationship among image data, the laser exposure time, the toner attaching amount, and the printer output image density.

FIG. 12 shows image data, laser exposure time (pulse width) PD, toner attaching amount Q, and printer output image density ID. When a color laser printer to which the present invention is applied is part of a digital copying machine, laser exposure time PD, toner attaching amount Q, and printer output image density ID for given gradation data have a correspondence therebetween. When toner attaching amount Q varies (alternate long and short dashed curve g) due to deterioration over time or a change in environment, the relationship between image data and toner attaching amount Q can be made constant by changing the contents of a conversion table between gradation data and laser exposure time PD (alternate long and two short dashed curve h). The above conversion table can be stored in memory 387 shown in FIG. 2A. This embodiment has a larger number of levels (e.g. 4096 levels) of laser exposure time PD than that of gradation data (256 levels), and a may be provided with a selection circuit by which various laser exposure times PD each corresponding to gradation data can be optionally selected.

The mutual relation among Q, ID, and VC can be read from a combination of the graphs of FIGS. 5 and 12.

Toner sensor 8 will be described in detail below.

Figure 13:
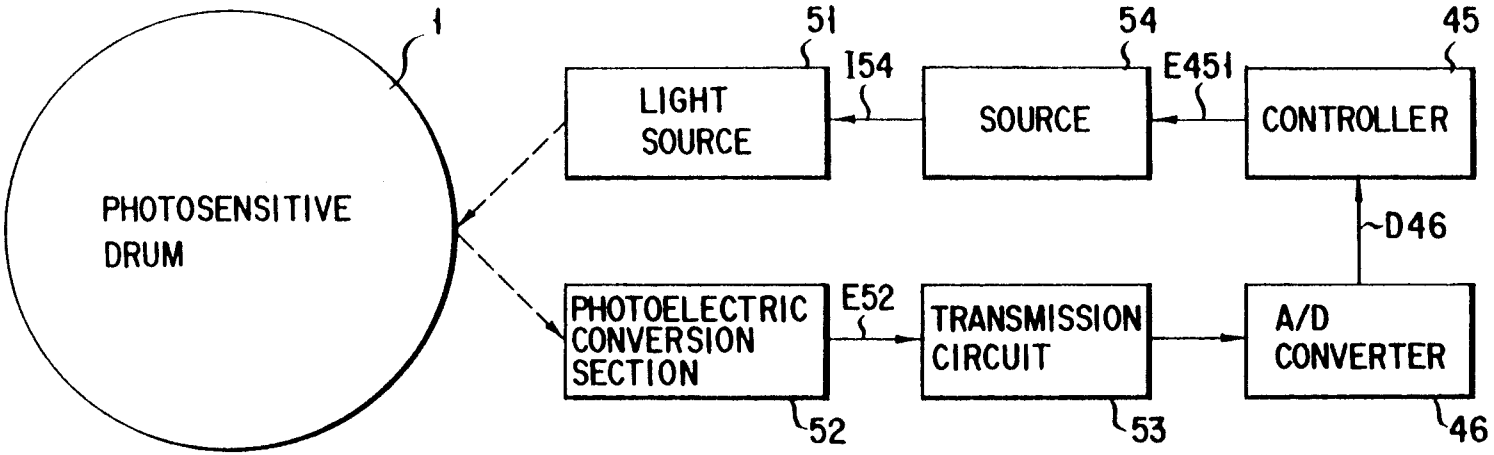
FIG. 13 is a block diagram showing an arrangement of a toner sensor.

FIG. 13 shows an arrangement of toner sensor 8. In FIG. 13, light from light source 51 is radiated on the surface of photosensitive drum 1. Light reflected by the surface of photosensitive drum 1, or by toner DM developed and attached on drum 1, is converted into a current according to the amount of reflected light by photoelectric conversion section 52, and the current is then current-to-voltage converted into signal E52. Signal E52 is supplied to A/D converter 46 through transmission circuit 53, and is converted into digital signal D46. Digital signal D46 represents the amount (Q) of toner DM attached on drum 1, and is fetched by controller 45.

Light source 51 is driven by output current I54 from light source driver 54. Light source driver 54 is ON/OFF-controlled by control signal E451 from controller 45, and adjusts the amount of drive current I54 input to light source 51 according to signal E451.

Figure 14:
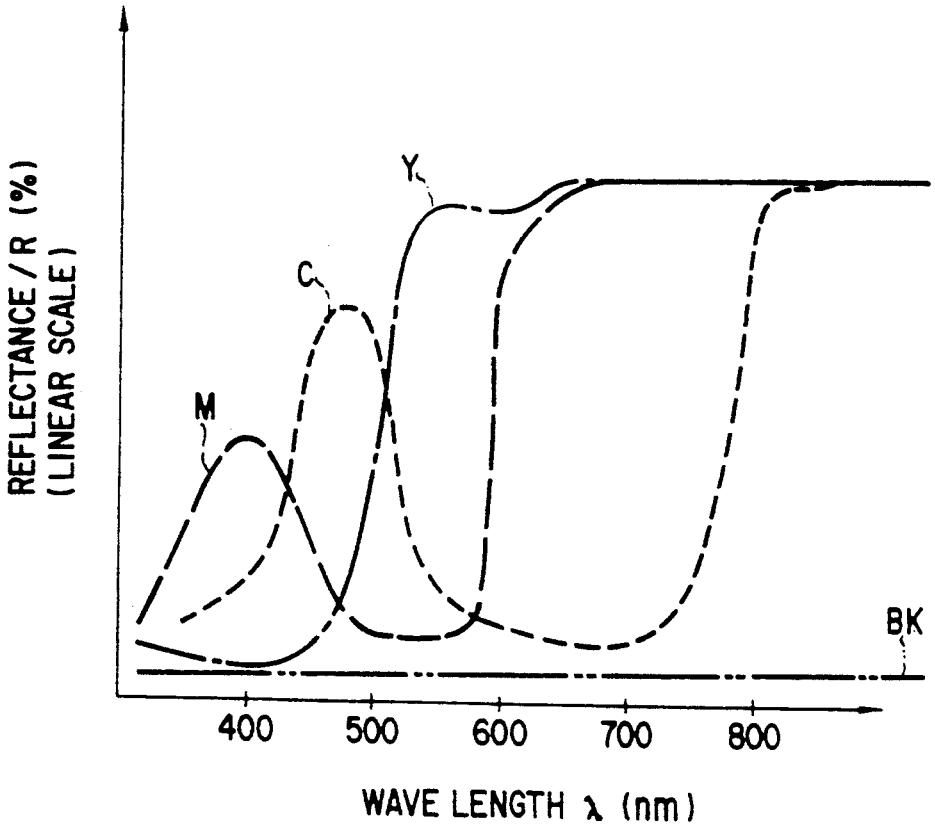
FIG. 14 is a graph showing the spectral reflectance of a printer output image.

FIG. 14 shows the spectral reflectances of output images. More specifically, FIG. 14 shows the spectral reflectances of images obtained solely by outputting yellow Y, magenta M, cyan C, and black BK toners, using a color printer.

Figure 15:
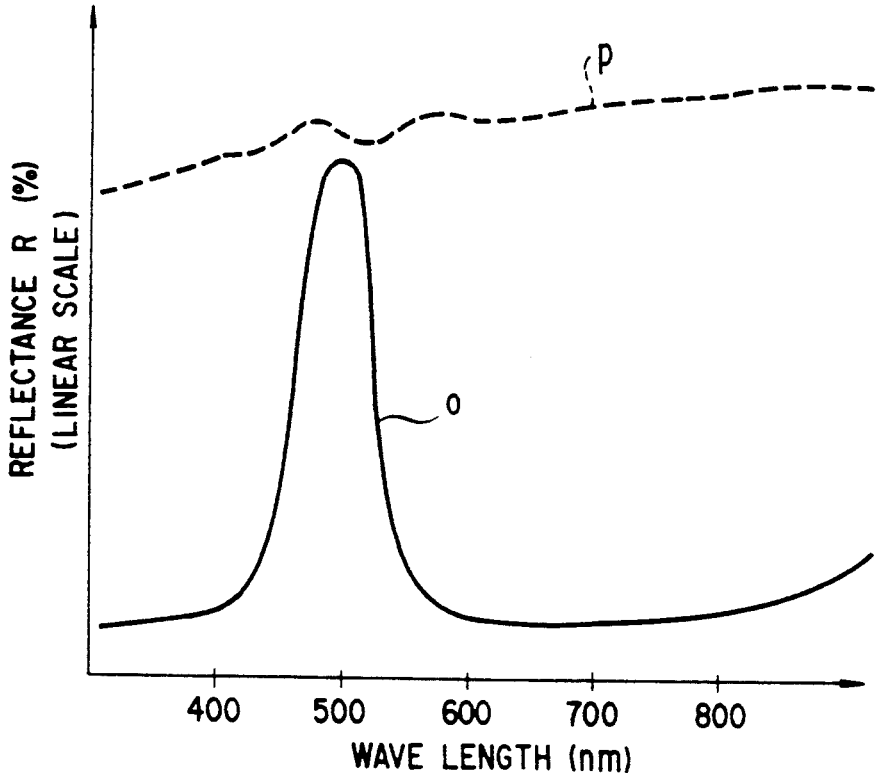
FIGS. 15 and 15A show the mirror surface reflectance of the photosensitive drum at different light incident angles.
Figure 15A:
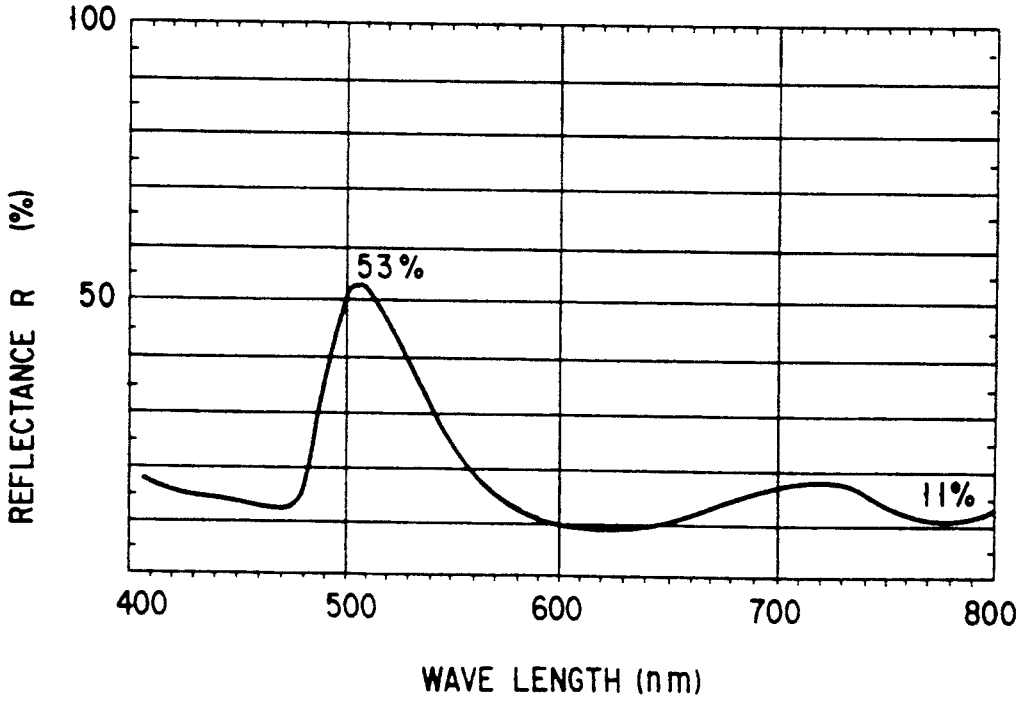

FIGS. 15 and 15A show the mirror surface refectances of photosensitive drum 1 at different incident angles. In FIG. 15, a mirror surface reflectance at a relatively shallow (or small) angle (θ) with respect to the normal to the reflection surface of drum 1 is represented by curve o, and a mirror surface reflectance L at a deep (or large) angle (θ) is represented by broken curve p. FIG. 15 teaches that the wavelength dependency of reflection is reduced as the angle ($\theta$) becomes deeper. (FIG. 15A exemplifies the case where reflectance R=53% is obtained at wavelength $\lambda$=510 nm, and R=11% is obtained at $\lambda$=800 nm.)

Figure 16:
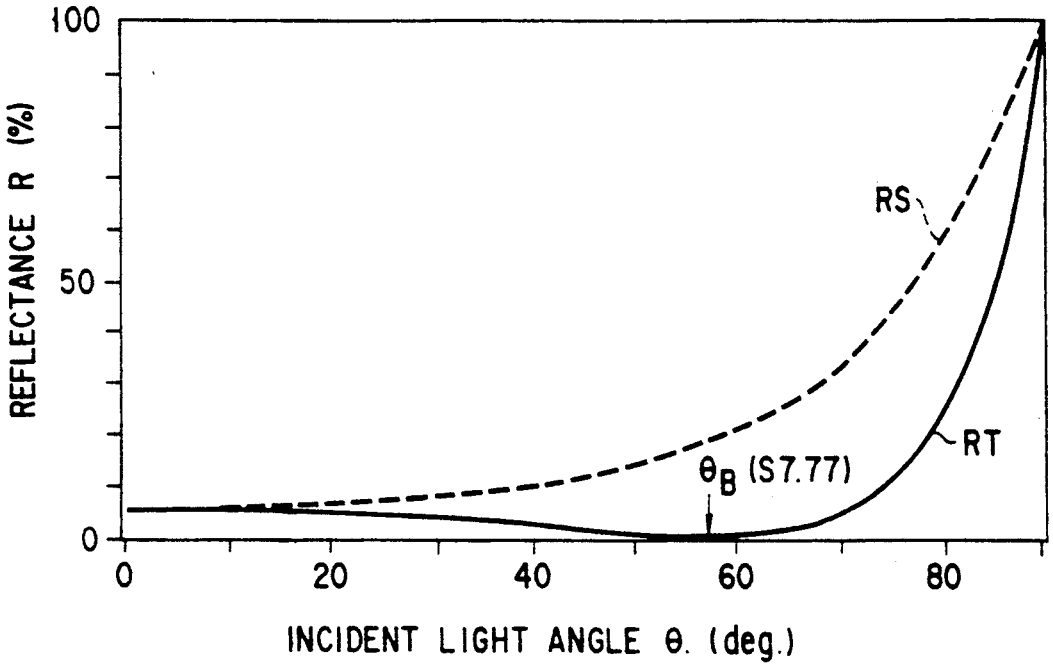
FIG. 16 is a graph showing the reflection characteristics of a photosensitive drum surface as a function of the light incident angle FIG. 16A explains how the reflectance can be obtained.

This can also understood from the fact that refection of the surface of a polycarbonate (refractive index=1.586) has characteristics with respect to the incident angle, as shown in FIG. 16. In FIG. 16, curve RT represents a reflectance in a direction parallel to the incident angle, and curve RS represents a reflectance in a direction perpendicular to the incident angle. Therefore, when the incident angle is shallow, the amount of light, which is transmitted through a photosensitive layer of the photosensitive drum, is reflected by a conductive support member, having a metallic gross, for supporting the photosensitive layer, and is again transmitted through the photosensitive layer, is larger than that of light reflected by the surface of the photosensitive drum.

Figure 16A:
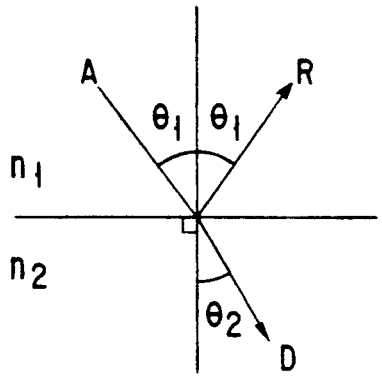

FIG. 16A explains how reflectance R can be obtained. In the figure, reference symbol A denotes an input light beam with incidence angle $\theta_1$; R, an reflected light beam with reflection angle $\theta_1$; and D, a transit light beam running from refractive index n1 area to refractive index n2 area, with angle $\theta_2$.

Assume that amplitude reflection factor r of the parallel component with respect to the incidence angle is denoted by rT; that reflectance R of the parallel component with respect to the incidence angle is denoted by RT; and that the perpendicular component with respect to reflectance R is denoted by RS.

Since the relation "$n1 \cdot \sin\theta_1 = n2 \cdot \sin\theta_2$" is obtained from Snell's law of refraction, the following equations are derived from the Fresnel's formulas:

$$\left.\begin{aligned} rT &= (\tan(\theta_1 - \theta_2)/\tan(\theta_1 + \theta_2)) \\ rS &= -(\sin(\theta_1 - \theta_2)/\sin(\theta_1 + \theta_2)) \\ RT &= rT^2 \\ RS &= rs^2 \end{aligned}\right\} \quad (7)$$

In FIG. 16, parallel component RT becomes zero at Brewster's angle (polarizing angle) $\theta_B$ of incidence angle $\theta(=\theta_1)$. (In the embodiment wherein the main component of a paper is polycarbonate, $\theta_B$ is 57.777 degrees.)

When a polarizing filter (not shown) is arranged in front of a photodetector (not shown) is arranged in front of a photodetector (not shown) in toner attaching amount sensor 8 so that perpendicular component RS input to the photodetector is cut out, direct reflection light to sensor 8 can be eliminated, provided that parallel component RT is cancelled out with Brewster's angle $\theta_B$. Further, complete elimination of the direct reflection light can be avoided, if the angle of the polarizing filter is adjusted so as to guide a desired amount of the direct reflection light to sensor 8.

In in the case of photosensitive drum 1 of this embodiment, a shallow incident angle is set for color toners (Y, M, and C), and the wavelength of light emitted from light source 51 is set to fall within a wavelength region of 800 nm or higher, thus widening the dynamic range. As for a black toner, light becomes incident at a relatively deep angle, and the wavelength range is not limited to a range between 300 nm and 1,000 nm.

Figure 17:
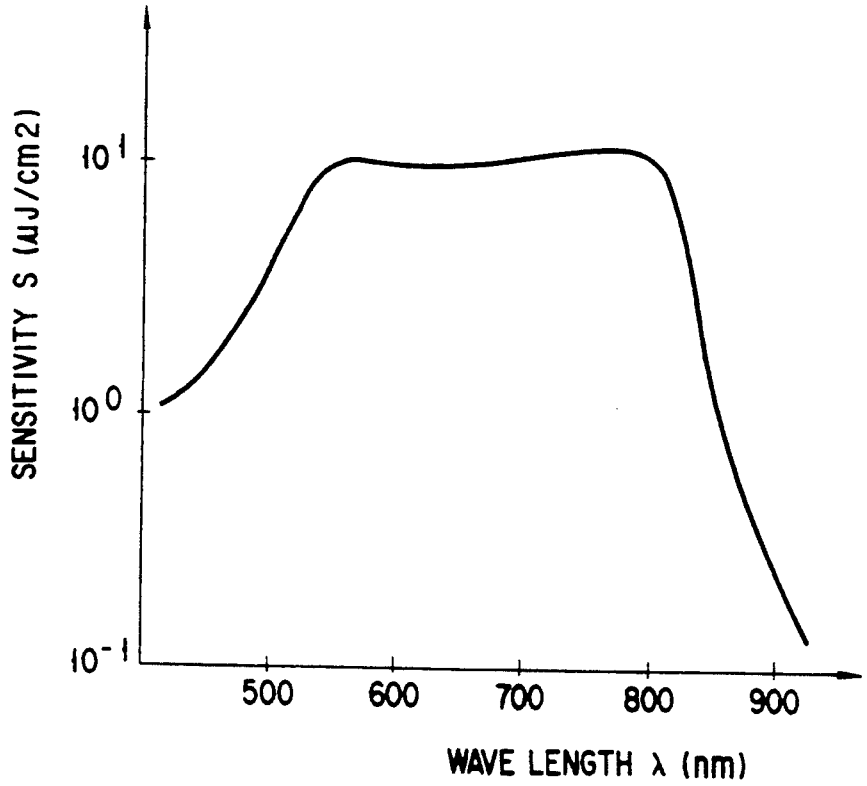
FIG. 17 is a graph showing the photosensitivity characteristics of the photosensitive drum

However, as shown in FIG. 17, since the photosensitivity of the photosensitive drum has a high level in a wavelength range between 500 nm and 800 nm, the wavelength in this range is not used, so as to avoid stray light to an image region due to mirror surface reflection, scattering of a toner image as an object to be measured, and the like. In this embodiment, a wavelength other than a wavelength 1/10 the highest sensitivity level, i.e., a wavelength of 860 nm or higher, and preferably, a wavelength falling within a range of 860 nm and 1,000 nm was selected. In this case, as photoelectric conversion section 52, a photodiode having a sensitivity (a conversion current amount with respect to a received light amount) shown in FIG. 18 was used.

Figure 19:
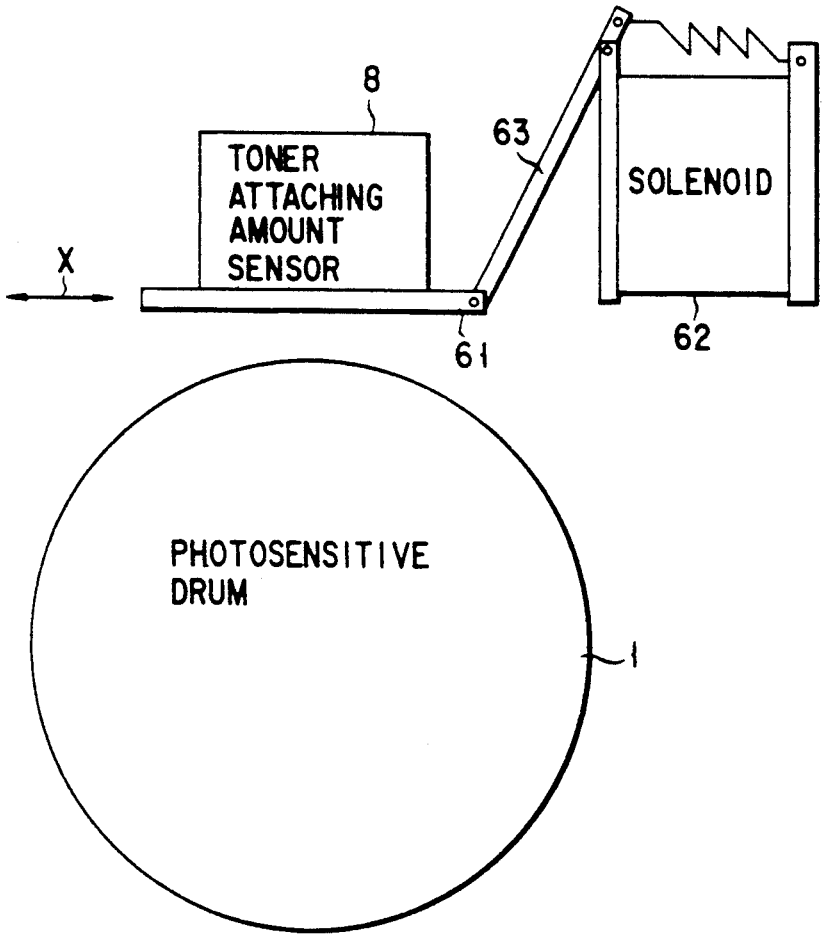
FIG. 19 is a view showing a state of a shielding member arranged between the toner sensor and the photosensitive drum.

FIG. 19 shows a state of a shielding member arranged between toner sensor 8 and photosensitive drum 1. More specifically, toner sensor 8 is arranged, so that its measurement surface opposes the surface of photosensitive drum 1. Plate-like shielding member 61 is arranged to be able to be opened/closed in the vicinity of the measurement surface side of toner sensor 8. One end of shielding member 61 is coupled to flapper 63 of solenoid 62 via a pin. Shielding member 61 is moved to the right and left, i.e., in a direction of a double-headed arrow X in FIG. 19 according to an opening/closing operation of flapper 63 upon an ON/OFF operation of solenoid 62.

Shielding member 61 is closed in a non-measurement mode of toner sensor 8, thereby shielding the measurement surface from external environment. Shielding member 61 is opened in only a measurement mode, thus eliminating the measurement surface from being contaminated with scattered toner. As a result, the period of high-accuracy measurement can be prolonged.

In this manner, according to the above embodiment, the amount of a toner attached on the photosensitive drum upon development is measured. The measured toner attaching amount is compared with a predetermined reference value. At least one of the charging amount for the photosensitive drum, the developing bias voltage, the exposure amount, the toner density, and the like is changed on the basis of the comparison result. Thus, an image density drift due to a change in environment or a deterioration over time can be corrected independently of the maintenance, and at a shorter cycle than the maintenance cycle. As a result, a high image density can be stabilized, and cost (labor cost, equipment, and the like) required for the maintenance can be reduced.

Figure 20:
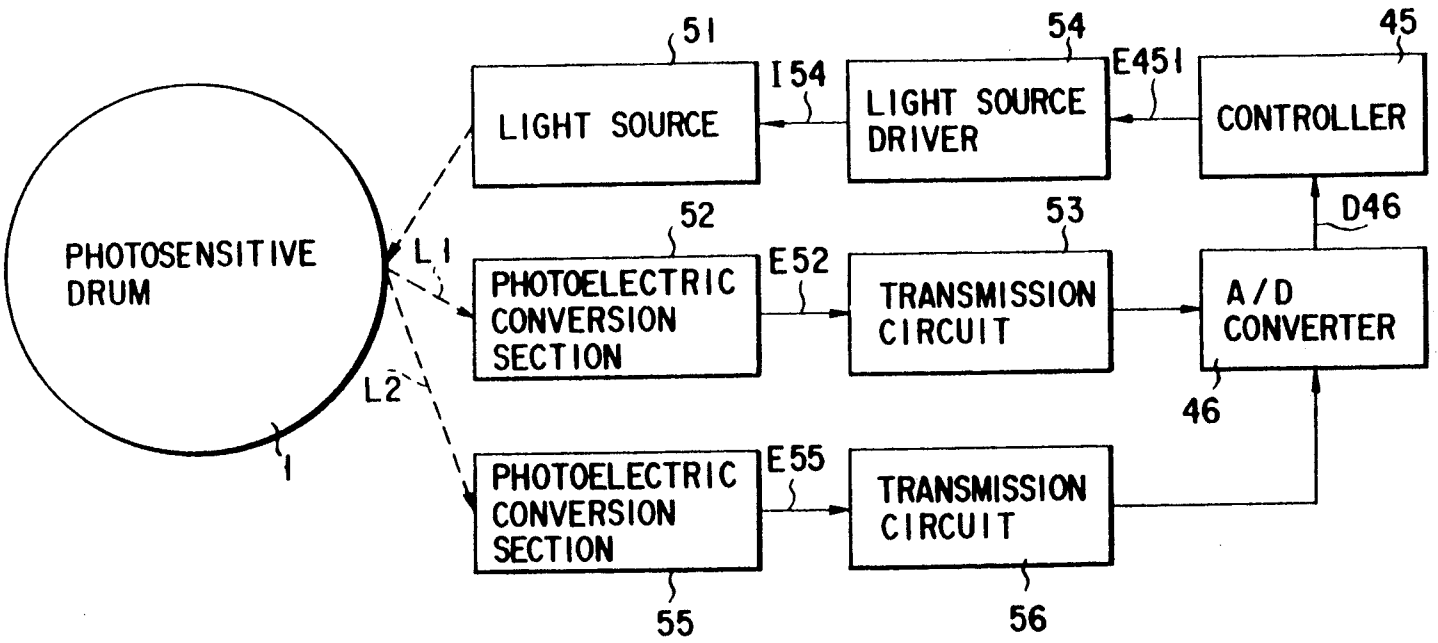
FIG. 20 is a block diagram showing another arrangement of the toner sensor.

FIG. 20 shows another arrangement of toner sensor 8. The same reference numerals in FIG. 20 denote the same parts as in FIG. 13, and a detailed description thereof will be omitted. Thus, only different portions will be described below. In FIG. 20, light from light source 51 is radiated on the surface of photosensitive drum 1. Light reflected by the surface of photosensitive drum 1, or by a toner developed and attached on drum 1, is converted into currents according to the amount of reflected lights L1 and L2 by first and second photoelectric conversion sections 52 and 55, and the currents are respectively current-to-voltage converted into signals E52 and E55. Signals E52 and E55 are supplied to A/D converter 46 through transmission circuits 53 and 56, and are converted into digital signal D46. Digital signal D46 is then fetched by controller 45.

First photoelectric conversion section 52 is arranged at a position where it can receive reflected light including principal ray L1 obtained upon reflection of the principal ray emitted from light source 51 by the surface of photosensitive drum 1, and second photoelectric conversion section 55 is arranged at a position where it can receive reflected light L2 but including no principal ray obtained upon reflection of the principal ray emitted from light source 51 by the surface of photosensitive drum 1. Thus, first photoelectric conversion section 52 receives mirror surface reflected light L1 by the surface of photosensitive drum 1, and second photoelectric conversion section 55 receives divergent reflected light L2 by the surface of photosensitive drum 1.

Figure 21:
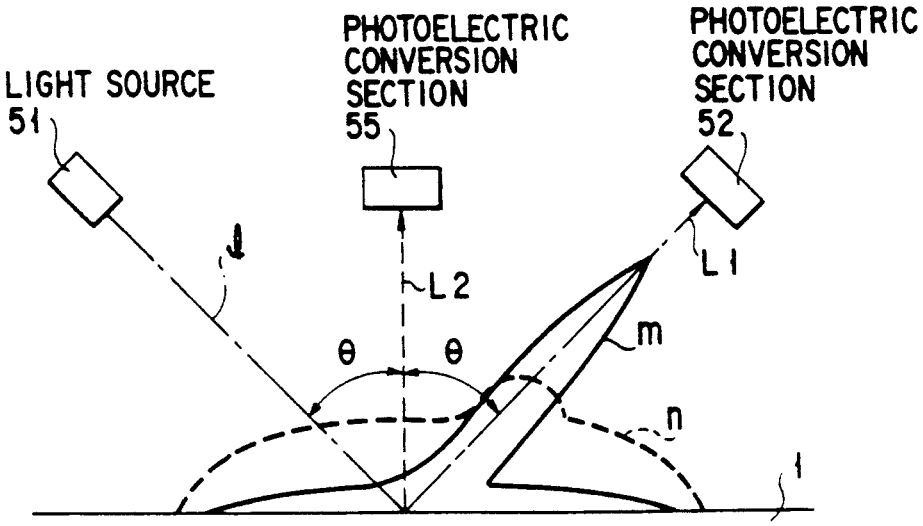
FIG. 21 is a view showing first and second photoelectric conversion units, and the reflected light distribution of a photosensitive drum shown in FIG. 20.

FIG. 21 shows first and second photoelectric conversion sections 52 and 55, and the reflected light distribution of photosensitive drum 1. Principal ray l from light source 51, and principal ray L1 of light reflected by photosensitive drum 1 are indicated by an alternate long and short dashed curve. Divergent reflected light L2 is indicated by a broken curve.

Solid curve m represents the reflected light distribution on photosensitive drum 1 on which no toner is attached. At angle $\theta$ of principal ray l of reflected light, the light amount (L1) based on mirror surface reflection of the surface of photosensitive drum 1 and the conductive support member for supporting a photosensitive layer is large. At an angle other than angle $\theta$, divergent light scattered by the surface of the photosensitive drum, the photosensitive layer, and the conductive support member is detected. Thus, divergent reflected light (L2) has a smaller light amount than that of mirror surface reflected light (L1).

When a toner becomes attached to the surface of photosensitive drum 1 upon development, the reflected light distribution becomes as indicated by broken curve n. Mirror surface reflected light is scattered by toner particles and is decreased in amount, while divergent reflected light is increased in amount. Therefore, first photoelectric conversion section 52 measures the amount of decrease in mirror surface reflected light (L1), and second photoelectric conversion section 55 measures the amount of increase in divergent reflected light (L2).

In measurement of the toner attaching amount by mirror surface reflected light, when the toner attaching amount exceeds a given value, a change in light amount of mirror surface reflected light becomes very small. When the toner attaching amount is decreased below a given value, the light amount of divergent reflected light becomes smaller than that on photosensitive drum 1 on which no toner is attached although it depends on a particular toner and photosensitive body used.

Therefore, both mirror reflected light and divergent reflected light are measured, and toner attaching amounts are calculated based on these light amounts at that time. Thus, a wide-range measurement with higher accuracy can be performed as compared to a measurement using one of mirror reflected light and divergent reflected light.

As described above, according to the present invention, an image forming apparatus, which can correct an image density drift caused by a change in environment or a deterioration over time independently of the maintenance, and at a shorter cycle than the maintenance cycle, can stabilize a high image density, and can reduce maintenance cost, can be provided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

means for generating gradation data for a test pattern containing a high density portion and a low density portion;

means for supplying image information of the gradation data generated by said generating means to an image carrier, said image carrier having a contrast potential depending on the high density portion, and a background potential depending on the low density portion;

means for sensing the image information supplied from said supplying means to the image carrier so as to provide a high density value corresponding to the high density portion and a low density value corresponding to the low density portion;

first detecting means for detecting a first difference between a high density reference value and the high density value provided by said sensing means;

second detecting means for detecting a second difference between a low density reference value and the low density value provided by said sensing means;

first converting means for converting the first and second differences, respectively, detected by said first and second detecting means into a first variable based on a first predetermined relationship among the first difference, second difference and the first variable;

second converting means for converting the first and second differences, respectively, detected by said first and second detecting means, into a second variable based on a second predetermined relationship among the first difference, second difference and the second variable;

first modifying means for modifying the contrast potential of said image carrier using the first variable obtained by said first converting means; and second modifying means for modifying the background potential of said image carrier using the second variable obtained by said second converting means.

2. An image forming apparatus according to claim 1, further comprising:

means for applying a grid bias voltage to said image carrier; and means for applying a developing bias voltage to said image carrier having contrast potential and background potential, each said grid base voltage and developing bias voltage corresponding to a combination of the contrast potential and the background potential.

3. An image forming apparatus according to claim 2, further comprising:

first determining means for determining the grid bias voltage based on the contrast potential, modified by said first modifying means, and the background potential, modified by said second modifying means.

4. An image forming apparatus according to claim 3, further comprising:

second determining means for determining the developing bias voltage based on the background potential and the grid bias voltage determined by said first determining means.

5. An image forming apparatus comprising:

means for generating gradation data for a test pattern containing a high density portion and a low density portion;

means for supplying image information of the gradation data generated by said generating means to an image carrier to which a toner is attached;

means for sensing the image information supplied from said supplying means to the image carrier so as to provide a high density value corresponding to the high density portion and a low density value corresponding to the low density portion;

first detecting means for detecting a first difference between a high density reference value and the high density value provided by said sensing means;

second detecting means for detecting a second difference between a low density reference value and the low density value provided by said sensing means;

first comprising means for comparing an absolute value of the first difference, detected by said first detecting means with a first comparison reference, so as to provide a first comparison result if the absolute value of the first difference is larger than the first comparison reference;

second comparing means for comparing an absolute value of the second difference detected by said second detecting means with a second comparison reference, so as to provide a second comparison result if the absolute value of the second difference is larger than the second comparison reference;

means for changing the high density value provided by said sensing means, so as to decrease the absolute value of the first difference during which the first comparison result is provided by said first comparing means; and means for changing the low density value provided by said sensing means, so as to decrease the absolute value of the second difference during when the second comparison result is provided by said second comparing means.

6. An image forming apparatus comprising:

means for supplying an image carrier with image information containing gradation data having a high density portion and a low density portion;

means for applying a grid bias voltage and a developing bias voltage to said image carrier having a contrast potential depending on the high density portion and a background potential depending on the low density portion,, each said grid bias voltage and a developing bias voltage corresponding to a combination of the contrast potential and the background potential;

means for sensing the image information supplied from said supplying means to the image carrier so as to provide a high density value corresponding to the high density portion and a low density value corresponding to the low density portion;

means for detecting the contrast potential an the background potential in accordance with the high and low density values provided by said sensing means;

first determining means for determining the grid bias voltage based on the contrast potential and the background potential; and second determining means for determining the developing bias voltage based on the background potential and the grid bias voltage determined by said first determining means.

7. An image forming apparatus comprising:

means for supplying an image carrier with image information containing gradation data having a high density portion and a low density portion;

means for applying a grid bias voltage and a developing bias voltage to said image carrier having a contrast potential depending on the high density portion and a background potential depending on the low density portion, each said grid bias voltage and developing bias voltage corresponding to a combination of the contrast potential and the background potential;

means for sensing the image information supplied from said supplying means to the image carrier so as to provide a high density value corresponding to the high density portion and a low density value corresponding the low density portion;

first detecting means for detecting a first difference between a high density reference value and the high density value provided by said sensing means;

second detecting means for detecting a second difference between a low density reference value and the low density value provided by said sensing means;

first converting means for converting the first and second differences, respectively, detected by said first and second detecting means into a first variable based on a first predetermined relationship among the first difference, second difference and the first variable;

second converting means for converting the first and second differences, respectively, detected by said first and second detecting means, into a second variable based on a second predetermined relationship among the first difference, second difference and the second variable;

first modifying means for modifying the contrast potential of said image carrier using the first variable obtained by said first converting means;

second modifying means for modifying the background potential of said image carrier using the second variable obtained by said second converting means;

first determining means for determining the grid bias voltage based on the contrast potential, modified by said first modifying means, and the background potential, modified by said second modifying means; and second determining means for determining the developing bias voltage based on the background potential and the grid bias voltage determined by said first determining means.

* * * * *